US005178275A

United States Patent [19]

Fitzgerald et al.

[11] Patent Number: 5,178,275

[45] Date of Patent: Jan. 12, 1993

[54] EIGHT-SIDED COLUMNAR CONTAINER

[75] Inventors: Robert J. Fitzgerald, Burbank, Ill.; Richard L. Fleury, 10555 W. 131st St., Orland Park, Ill. 60462

[73] Assignee: Richard L. Fleury, Alsip, Ill.

[21] Appl. No.: 802,575

[22] Filed: Dec. 5, 1991

[51] Int. Cl.[5] ..... B65D 90/16; B65B 1/04

[52] U.S. Cl. ..... 206/386; 53/456; 108/55.1; 229/109; 414/786

[58] Field of Search ..... 206/386, 595-600; 108/55.1, 55.3, 55.5, 56.1; 229/109; 53/456; 414/786

[56] References Cited

U.S. PATENT DOCUMENTS

| | | | |
|---|---|---|---|
| 1,883,323 | 10/1932 | Andrews . | |
| 3,261,533 | 7/1966 | Repking . | |
| 4,019,635 | 4/1977 | Boots | 206/596 |
| 4,089,417 | 5/1978 | Osbourne | 206/600 |
| 4,174,803 | 11/1979 | Shrontz et al. . | |
| 4,225,078 | 9/1980 | Croley . | |
| 4,296,860 | 10/1981 | Hsu et al. . | |
| 4,373,637 | 2/1983 | Shippell . | |
| 4,441,649 | 4/1984 | Nederveld | 206/386 |
| 4,511,080 | 4/1985 | Madsen et al. | 206/386 |
| 4,549,690 | 10/1985 | Rosenburg . | |
| 4,585,143 | 4/1986 | Fremow | 206/386 |
| 5,020,674 | 6/1991 | Thorud et al. . | |
| 5,036,979 | 8/1991 | Selz . | |

FOREIGN PATENT DOCUMENTS

| | | | |
|---|---|---|---|
| 0202363 | 11/1986 | European Pat. Off. | 206/386 |

*Primary Examiner*—Jimmy G. Foster
*Attorney, Agent, or Firm*—Baker & McKenzie

[57] ABSTRACT

An approved collapsible container is provided for the transport of bulk materials contained in sacks. A collapsible container, fabricated out of a blank, is easily attached to a wood pallet. Sacks of both materials are contained therein and a top placed overhead. The process may be repeated and two pallet/containers/top combinations may be transported simultaneously. The improved container is especially adaptable for the handling and transport of bulk mail.

15 Claims, 2 Drawing Sheets

EIGHT-SIDED COLUMNAR CONTAINER

BACKGROUND AND SUMMARY OF THE INVENTION

This invention relates generally to containers for the handling and transport of bulk materials such as bulk mail. Specifically, the invention relates to stackable containers for the storage and transport of bulk materials made from a blank of foldable sheet material, a pallet and a top.

In the transport and storage of various types of bulk material (e.g. sacks of mail, sacks of durable produce, etc.), a problem has arisen as to the efficient handling, containment, and transport of bags of material. It is customary for workers to simply pile bags of material, such as bulk mail, on top of pallets and then shrink-wrap plastic around the material to keep it from falling off the pallet. This procedure is both costly and time consuming. Further, if the material is not shrink-wrapped properly, one or more bags may fall off the pallet while being lifted by a forklift and thereby possible causing injury to a worker or damage to the material.

Therefore, a need has arisen for the construction of an inexpensive, yet durable container to be a fixed to a pallet for the transport of bulk materials such as bags of mail. Ideally, the container should have stacking ability, thereby enabling the transport of two loaded pallets simultaneously. Further, the container must be easily assembled and easily affixed to a pallet. Containers that are currently available are cumbersome to assemble and do not provide a time-efficient solution to the shrink-wrap method.

Various receptacles for these types of purposes have been used in the past, however none have fulfilled the above-mentioned criteria.

BRIEF DESCRIPTION OF THE INVENTION

In accordance with one embodiment of the invention, a container for the storage and transport of bulk materials such as bulk mail is provided which is formed from a blank of foldable sheet material, a top and a pallet. The container is formed from the blank of foldable sheet material and includes four upright side panels including two first side panels and two second side panels. Four upright corner panels, each one being disposed in between and foldably connected to a first side panel and a second side panel combine with the four side panels to provide a generally octagonally shaped enclosure.

The four upright side panels and four upright corner panels each include bottom flaps. The four bottom flaps associated with the upright side panels fold radially inward while the four bottom flaps associated with the corner panels fold radially outward. The container is placed over a pallet in such a configuration so that the side panels line up with the sides of the pallet with the bottom flaps associate with the side panels folding inward. The bottom flaps associated with the corner panels are then affixed to the pallet. The pallet provides the bottom to the octagonally shaped container body. The bottom flaps of the side panels which fold inward are long enough to actively engage the sacks of bulk contents to be loaded inside the octagonal enclosure.

The sacks of bulk contents act to push the bottom flaps of the side panels down for frictional engagement with the top of the pallet. This action, eliminates the need for the cumbersome step of attaching the bottom flaps of the side panels to the pallet. The downward force of the sacks on the bottom side flaps along with the attachment of the bottom corner flaps to the pallet maintains the integrity of the container despite it being loaded with heavy bags of bulk contents. Further, because the bottom flaps fold inwardly and outwardly in an alternating fashion, the bottom flaps add structural stability to the upright panels. A top is provided with downwardly extending flaps to circumferentially engage the eight upwardly protruding walls of the octagonal enclosure. Holes in the top provide a view to the bags of bulk contents inside the container. The top also provides a stacking platform for a like pallet container and top. The side wall panels and corner panels should be in matching registry for columnar support.

BRIEF DESCRIPTION OF THE DRAWINGS

The invention is illustrated more or less diagrammatically in the accompanying drawings wherein.

DETAILED DESCRIPTION OF THE INVENTION

Figure 1:
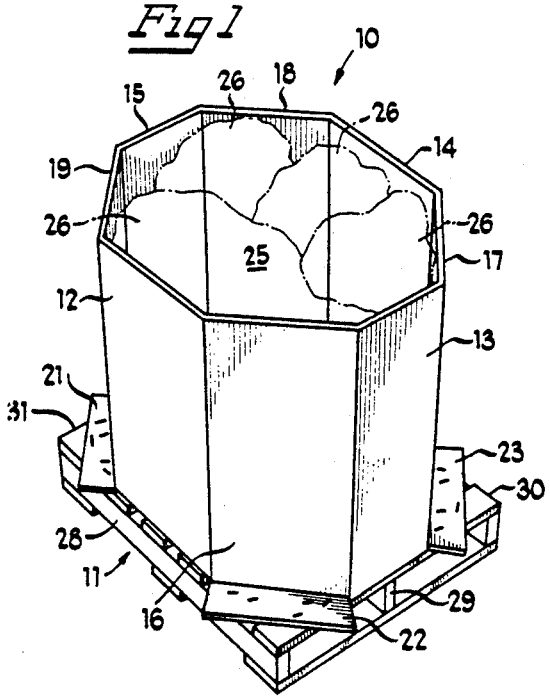
FIG. 1 is a prospective view of one embodiment of the improved container shown secured to a conventional pallet and loaded with sacks of bulk materials.

Like reference numerals will be used to refer to like or similar parts from Figure to Figure in the following description of the drawings.

Figure 2:
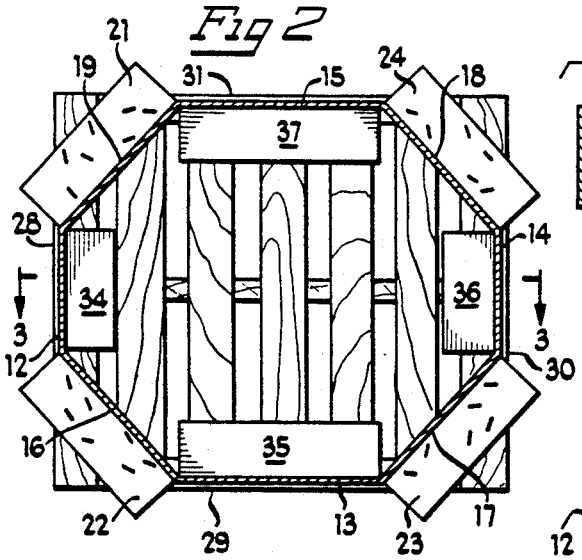
FIG. 2 is top plan view of the container/pallet depicted in FIG. 1 without the sacks of bulk materials.

FIG. 1 shows a typical collapsible container shown generally at 10 made in accordance with this invention as attached to a standard wood pallet 11. The collapsible container 10 has four side panels 12, 13, 14, and 15 and four corner panels 16, 17, 18 and 19. The bottom corner flaps, 21, 22, 23 and 24 (see FIG. 2), are affixed to the pallet 11 prior to filling the assembled octagonal enclosure, shown generally at 25, with bags of bulk material, shown generally at 26. By affixing the bottom corner flaps 21–24 to the pallet 11 before loading the container 25, is assured that the container 25 will maintain the preferred orientation with respect to the pallet 11, namely the alignment of side panels 12–15 with the sides of the pallet 28, 29, 30 and 31.

The bottom side flaps 34, 35, 36, and 37 fold radially inward. The bottom side flaps 34–37 are long enough to be functionally engaged by the sacks of bulk materials 26. The sacks of bulk materials 26 provide a downwardly anchoring force on tops the bottom side flaps 34–37 thereby assuring that each bottom side flap surface frictionally engages the upper surface of the pallet. This physical relationship maintains the integrity of the side walls 12–15 when the container 25 is full of sacks of material 26 without the need for separately or individually attaching the bottom side flaps 34–37 to the pallet. Specifically, the downward anchoring force placed on bottom side flaps 34–37 prevents bulging of the lower ends of the side walls 12–15.

As evidenced in FIG. 1, the attachment of bottom sides flaps 34–37 to the pallet 11 would be a cumbersome and time-consuming step in the construction of the container 10. The operator would have to climb into enclosure 25 to affix the flaps 34–37 to the palate.

Figure 3:
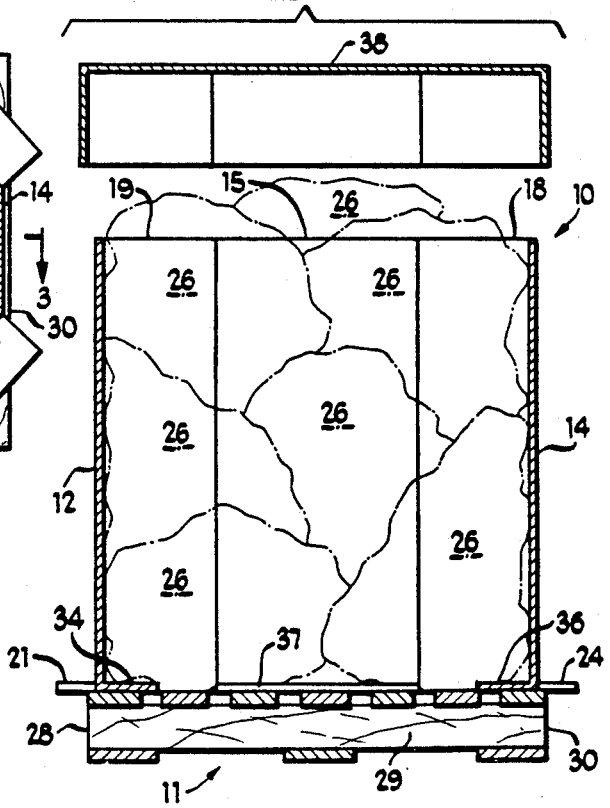
FIG. 3 is a partial sectional view taken along line 3—3 in FIG. 2 including a top.

FIG. 3 illustrates the physical relationship between the sacks of material 26 and the bottom flaps 34–37. For the most part, the entire bottom surfaces of bottom side flaps 34–37 maintain frictional engagement with the upper surface of pallet 11. It has been found that by making the internally directed 34–37 between about 4" and about 10" long, and preferably about 6" in width, a sufficient area for frictional engagement is provided, while minimizing the amount of paperboard stock which is used to manufacture the container. The width of the internally directed flaps 34–37 may also depend, to some extent, on the configuration of the boards, and spaces between the boards, of the pallet on which the container is placed.

There is another advantage to folding the bottom side flaps 34–37 inward and the bottom corner flaps 21–24 outward. The alternating inward-outward orientation of the bottom flaps 21–24 and 34–37 adds structural stability to all of the upright panels 12–19. The collapsible container 10 can be made taller and will still tolerate the outward forces imposed on the upright panels 12–19 by the sacks of material 26.

FIG. 3 also illustrates the proper construction of the top 38. The top 38 and the octagonal container 10 mateably engage in a male-female (enclosure 25 through top 38) relationship. The top 38 provides a stacking platform for a like pallet/container/top combination 10 overhead.

Figure 5:
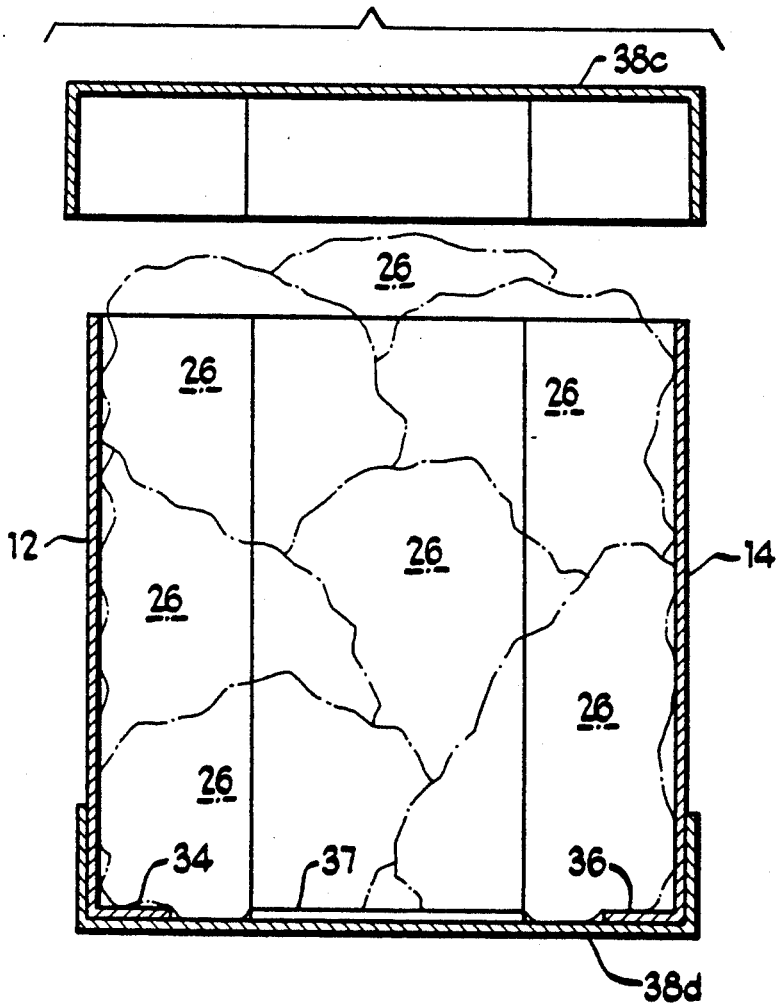
FIG. 5 is a partial sectional view taken along line 3—3 of FIG. 2 and also shows a top and bottom cap without a pallet.

Referring to FIG. 5, it should also be recognized that a top 38 may be substituted for a pallet 11. The bottom corner flaps 21–24 should be folded outward, and the bottom side flaps 34–37 should be folded inward to maintain the aforenoted inward-outward orientation. Use of a top 38 instead of a pallet 11 for the bottom conserves vertical space.

Figure 4:
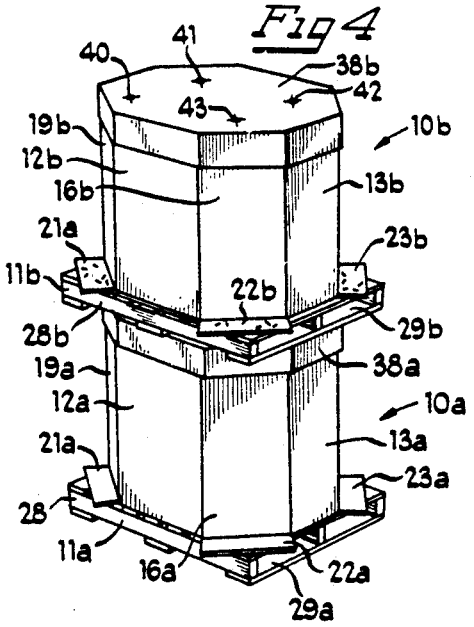
FIG. 4 shows two pallet/container/top combinations stacked in matching registry.

FIG. 4 illustrates the stacking ability of the pallet/-container/top combinations 10 made in accordance with the present invention. Before the discovery of the present invention, postal workers would simply pile bags of bulk mail on top of pallets and would stretch wrap around the sacks of mail to keep them from falling off the pallet during lifting and transporting. The octagonal and columnar shape of the container provides it with the strength to allow the placement of a greater number of sacks per pallet than can be achieved by using the stretch wrap technique. As evidenced in FIG. 4, sacks of bulk mail are neatly contained in vertically stacked octagonal containers 10*a* and 10*b* and transported simultaneously. More than twice the amount of bulk mail or other materials may be transported per truckload, since the height of a stacked pair of containers is less than the inside vertical dimension of a typical semi-trailer. Accordingly, the present invention drastically reduces handling and transport costs of materials contained in large sacks.

Bulk mail, and other materials contained in sacks, can now be transported in a more efficient manner. FIG. 4 illustrates a constructed container 10*a* with a like container 10*b* stacked vertically. Referring to the part numbers in FIGS. 1–4, the method of constructing the two container combination 10*a*–10*b* shown in FIG. 4 is as follows.

A pallet 11*a* is set on the floor. A blank 10*a* is provided having four side walls 12*a*–15*a* and four corner walls 16*a*–19*a*. The bottom flaps associated with the corner panels 21*a*–24*a* are folded outward. The bottom flaps associated with the side panels 34*a*–37*a* are folded inward. Side panels 12*a*–15*a* are aligned with sides of the pallet 28*a*–31*a*, respectively. The bottom corner flaps 21*a*–24*a* are affixed to the top surface of the pallet by stapling, tacking, gluing or the like. Sacks of mail 26*a* or the like are loaded in the octagonal enclosure 25*a* thereby forcing bottom side flaps 34*a*–37*a* into frictional engagement with the top surface of the pallet 11*a*. Once the octagonal enclosure 25*a* is full, (and in some cases, slightly over full to allow for settling) a top 38*a* is placed on top for mateable engagement with the collapsible container 10*a*. The process is repeated and a like combination 10*b* may be stacked on top of the container 10*a*, and two containers 10*a* and 10*b* may be transported together.

Collapsible container 10 and top 38 may be constructed from a blank of single-ply or multiple-ply cardboard, paperboard or the like. The octagonal enclosure 25 is formed by sealing a single joint (not shown) located between any corner panel 16–19, and any side panel 12–15. Either the side panels 12–15, or the corner panels 16–19 will include an overlapping flange that will be glued to the adjacent panel. A three-inch overlapping flange is recommended for lightweight bulk materials; a five-inch overlapping flange is recommended for heavyweight bulk materials. Conventional glues may be used, as well as other sealing techniques. Other similar materials may be used within the scope of this invention. The pallets may be constructed of wood or other suitable materials.

Since postal requirements demand that postal inspectors have access to U.S. mail, the top 38 includes inspection ports 40–43 cut through the upper horizontal panel of the top 38. Postal inspectors can verify the contents of the containers by looking through the inspection ports 40–43 without removing the top 38 from the container.

Although a preferred embodiment of the invention has been illustrated and described, it will at once be apparent to those skilled in the art that variations may be made within the spirit and scope of the invention. Accordingly, it is intended that the scope of the invention be limited solely by the scope of the hereafter appended claims and not by the specific words in the foregoing description.

We claim:

1. A container for the storage and transport of bulk contents, the container comprising:

a top;

a container body;

a pallet, the pallet having a top surface;

the container body including four upright side panels including two first side panels and two second side panels;

four upright corner panels, each upright corner panel being disposed in between and foldably connected to one first side panel and one second side panel thereby providing a generally octagonally shaped container body;

the four upright side panels and the four upright corner panels each including a bottom flap foldably connected to bottom edges of each panel, each bottom flap having a upper side and a lower side;

the four bottom flaps associated with the four upright side panels folding radially inward, a means for maintaining frictional engagement between the lower side of each bottom flap associated with the four upright side panels and the top surface of the pallet;

the four bottom flaps associated with the four upright corner panels folding radially outward and being attached to the top of the pallet; and the pallet providing a bottom to the container body.

2. The container of claim 1, wherein the means for maintaining frictional engagement between the lower side of each bottom flap associated with the four upright side panels and the top of the pallet is the bulk contents whereby the bulk contents provide an anchoring downward force on the four bottom flaps associated with the four upright side panels ensuring that the lower surface each bottom flap associated with the four upright side panels is in frictional engagement with the top of the pallet.

3. The container of claim 1, wherein the top includes an octagonally shaped top panel with downwardly protruding side panels for mateably engaging the four upright side panels and the four upright corner panels of the container body, the top panel providing a stacking surface for a like container.

4. The container of claim 1, wherein the four bottom flaps associated with the four upright side panels are about 6 inches long.

5. The container of claim 1, wherein the four bottom flaps associated with the four upright side panels are from about 4 inches long to about 10 inches long.

6. The container of claim 1, wherein the bulk contents are sacks of bulk mail.

7. The container of claim 1, wherein the octagonally shaped top panel has a plurality of holes, each hole providing a view to bulk contents contained within the octagonally shaped enclosure.

8. The container of claim 1, wherein the bottom edge of each upright side panel is in substantial alignment with an edge of the pallet.

9. The container of claim 1, wherein a like container is stacked on the top panel providing a bottom combination and a top combination;

the upright corner panels of the top combination and bottom combination being in matching registry for columnar support of said top combination.

10. The container of claim 1, wherein the container body is fabricated from corrugated paperboard.

11. A container for storage and transport of sacks of bulk mail consisting essentially of:

a top;

a pallet, the pallet having a top surface;

a generally octagonally shaped receptacle;

the generally octagonally shaped receptacle fabricated from corrugated paperboard including four upright side panels including two first side panels and two second side panels;

four upright corner panels, each corner panel being disposed in between and foldably connected to one first side panel and one second side panel;

the four upright side panels and the four upright corner panels each including a bottom flap foldably connected to bottom edge of each panel, each bottom flap having a upper side and a lower side, each bottom flap being about six inches long;

the four bottom flaps associated with the four upright side panels folding radially inward and being of a sufficient length to engage the sacks of bulk mail whereby the sacks of bulk mail provide an anchoring downward force on the four bottom flaps associated with the four upright side panels, the lower side of each bottom flap associated with the four upright side panels frictionally engaging the top surface of the pallet;

the four bottom flaps associated with the four upright corner panels folding radially outward and being attached to the top of the pallet;

the pallet providing a bottom to the octagonally shaped receptacle;

the bottom edge of each side panel being in substantial alignment with a side of the pallet; and the top being octagonally shaped with downwardly protruding side panels for mateably engaging the four upright side panels and the four upright corner panels of the receptacle whereby the top panel provides a stacking surface for a pallet, associated receptacle and top.

12. A method for transporting bulk mail, the method comprising:

a) constructing a container to transport the bulk mail, the container including a top, a pallet, the pallet having a top and a bottom, a generally octagonally shaped receptacle, the generally octagonally shaped receptacle fabricated from corrugated paperboard including four upright side panels including two first side panels and two second side panels, four upright corner panels, each corner panel being disposed in between and foldably connected to one first side panel and one second side panel, the four upright side panels and the four upright corner panels each including a bottom flap foldably connected to bottom edge of each panel, each bottom flap having a upper side and a lower side, each bottom flap being about six inches long, the four bottom flaps associated with the four upright side panels folding radially inward and being of a sufficient length to engage the sacks of bulk mail whereby the sacks of bulk mail provide an anchoring downward force on the four bottom flaps associated with the four upright side panels, the lower side of each bottom flap associated with the four upright side panels frictionally engaging the top surface of the pallet, the four bottom flaps associated with the four upright corner panels folding radially outward and being attached to the top of the pallet, the pallet providing a bottom to the octagonally shaped receptacle, the bottom edge of each side panel being in substantial alignment with a side of the pallet, the top being octagonally shaped and including downwardly protruding side panels for mateably engaging the four upright side panels and the four upright corner panels of the receptacle whereby the top panel provides a stacking surface for a pallet, associated receptacle and top;

b) placing sacks of bulk mail in the receptacle;

c) placing the top over and mateably engaging the receptacle;

d) stacking a like container on the providing a bottom combination and a top combination whereby the upright corner panels of the top combination and bottom combination being in matching registry for columnar support of said top combination; and e) transporting the top and bottom combinations together.

13. A container for the storage and transport of bulk contents, the container comprising:

a top;

a container body;

a bottom;

the container body including four upright side panels including two first side panels and two second side panels;

four upright corner panels, each upright corner panel being disposed in between and foldably connected to one first side panel and one second side panel thereby providing a generally octagonally shaped container body;

the four upright side panels and the four upright corner panels each including a bottom flap foldably connected to bottom edges of each panel;

the four bottom flaps associated with the four upright side panels folding radially inward, the bulk contents providing an anchoring downward force on the four bottom flaps associated with the four upright side panels ensuring that the bottom flaps associated with the four upright side panels are in frictional engagement with the bottom;

the four bottom flaps associated with the four upright corner panels folding radially outward and being mateably engaged by the bottom;

the bottom includes an octagonally shaped bottom panel with upwardly protruding side panels for mateably engaging the four upright side panels and the four bottom flaps of the four upright corner panels of the container body; and the top includes an octagonally shaped top panel with downwardly protruding side panels for mateably engaging the four upright side panels and the four upright corner panels of the container body, the top panel providing a stacking surface for a like container.

14. The container of claim 13 wherein the four bottom flaps associated with the four upright side panels are from about 4 inches long to about 10 inches long.

15. The container of claim 13 wherein the container body is fabricated from corrugated paperboard.

* * * * *